US007837601B2

(12) United States Patent
Perry et al.

(10) Patent No.: US 7,837,601 B2
(45) Date of Patent: Nov. 23, 2010

(54) METHOD TO PREPARE FOR AND CONDUCT AN EXERCISE USING FREE WEIGHTS

(75) Inventors: David A. Perry, New York, NY (US); Paul M. Picciano, Windham, NH (US)

(73) Assignee: Mesacor, Inc., New York, NY (US)

( * ) Notice: Subject to any disclaimer, the term of this patent is extended or adjusted under 35 U.S.C. 154(b) by 0 days.

(21) Appl. No.: 12/319,922

(22) Filed: Jan. 14, 2009

(65) Prior Publication Data

US 2010/0179033 A1 Jul. 15, 2010

(51) Int. Cl.
*A63B 21/06* (2006.01)
*A63B 21/072* (2006.01)

(52) U.S. Cl. ..... 482/94; 482/98; 482/106

(58) Field of Classification Search ..... 482/92–94, 482/97, 98, 104, 106–108, 148; D21/686
See application file for complete search history.

(56) References Cited

U.S. PATENT DOCUMENTS

| | | | | | |
|---|---|---|---|---|---|
| 293,783 | A * | 2/1884 | Ransom | 211/23 |
| 4,648,595 | A * | 3/1987 | Selle | 482/104 |
| 4,822,034 | A * | 4/1989 | Shields | 482/106 |
| 4,834,396 | A * | 5/1989 | Schnell | 482/97 |
| 4,982,957 | A * | 1/1991 | Shields | 482/104 |
| 5,284,463 | A * | 2/1994 | Shields | 482/107 |
| 6,123,651 | A * | 9/2000 | Ellenburg | 482/104 |
| 6,595,902 | B1 * | 7/2003 | Savage et al. | 482/94 |
| 6,974,039 | B2 * | 12/2005 | Comartin et al. | 211/41.1 |
| 7,018,325 | B2 * | 3/2006 | Shifferaw | 482/104 |
| 7,022,053 | B2 * | 4/2006 | Whetstone | 482/104 |
| 7,578,771 | B1 * | 8/2009 | Towley et al. | 482/106 |
| 7,637,852 | B2 * | 12/2009 | Hoole | 482/104 |
| 2007/0099773 | A1 * | 5/2007 | Hummer | 482/104 |
| 2008/0248931 | A1 * | 10/2008 | Hoole | 482/104 |

* cited by examiner

*Primary Examiner*—Loan Thanh
*Assistant Examiner*—Victor K Hwang
(74) *Attorney, Agent, or Firm*—Tod R. Nissle, P.C.

(57) ABSTRACT

A method to prepare for and conduct an exercise using free weights while minimizing the risk of injury to an individual during the acquisition, use, and return of the free weights includes the step of providing a plurality of cylindrically-shaped free weight plates and a staging station. Each of the free weight plates is mounted on edge in an upright orientation in one of a plurality of detent units of the staging station at a height above the ground. A first one of the free weight plates is manually grasped and rolled from the detent unit onto a horizontally oriented support surface of the staging station, manually removed from the support surface, utilized to perform an exercise, manually returned to the support surface, and manually rolled on the peripheral edge of the first one of the free weight plates from the support surface into one of the detent units.

2 Claims, 4 Drawing Sheets

METHOD TO PREPARE FOR AND CONDUCT AN EXERCISE USING FREE WEIGHTS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF PARTIES TO A JOINT RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention relates to exercise equipment and methodology.

More particularly, the invention relates to apparatus for storing and using free weights.

(2) Description of Related Art Including Information Disclosed under 37 CFR 1.97 and 1.98

Racks for storing free weights are well known in the art. However, as has been demonstrated many times in the Patent Office, existing apparatus and methods often can be improved by utilizing an unidentified, unanticipated combination which provides functions that are unpredictable in view of the prior art.

Accordingly, it would be highly desirable to provide an improved system to store and utilize free weights.

Therefore, it is a principal object of the invention to provide an improved system to store and utilize free weights.

BRIEF DESCRIPTION OF THE SEVERAL VIEWS OF THE DRAWINGS

These and other, further and more specific objects and advantages of the invention are set forth below, in conjunction with the drawings, in which.

BRIEF SUMMARY OF THE INVENTION

Figure 1:
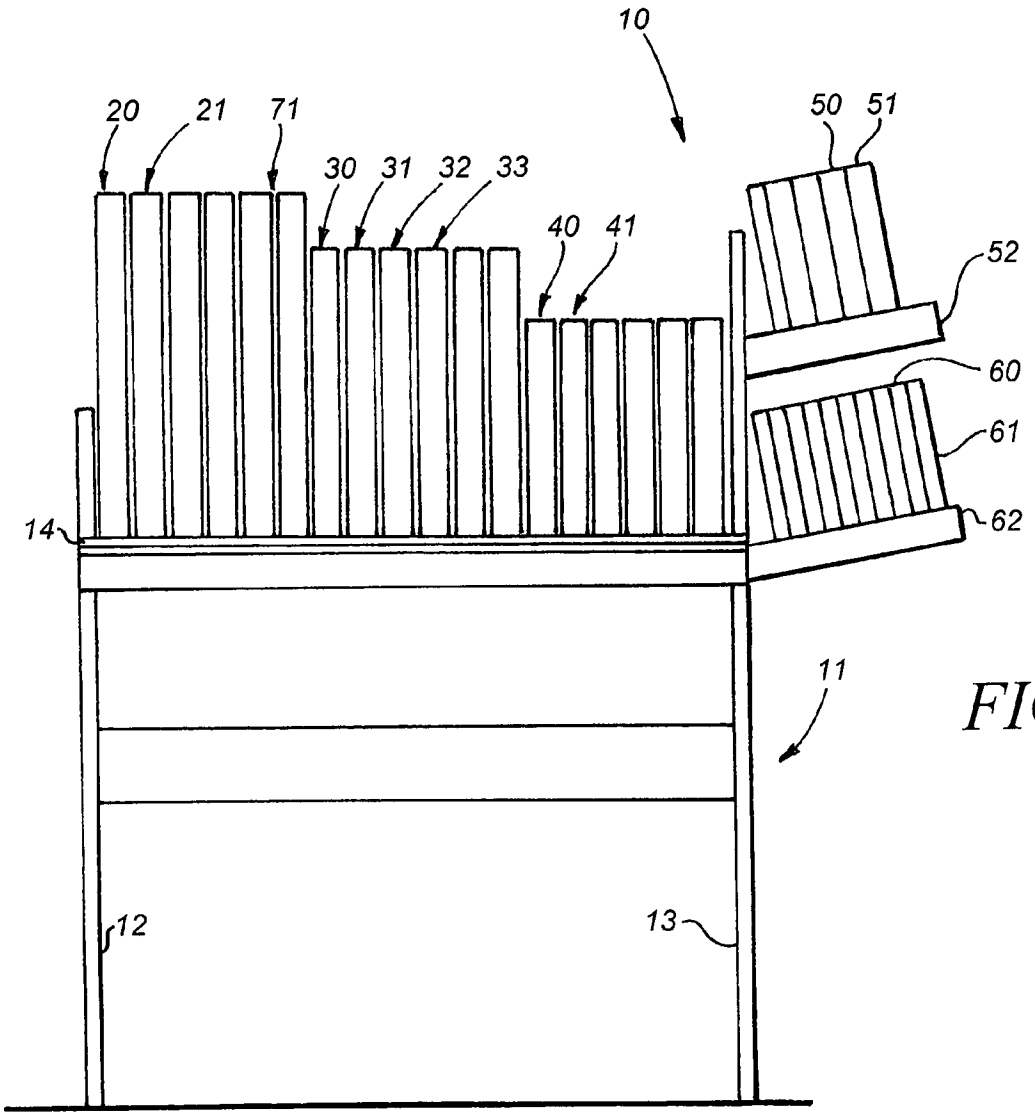
FIG. 1 is a front elevation view illustrating a free weight staging station constructed in accordance with the principles of the invention.

Briefly, in accordance with the invention, we provide an improved method to prepare for and conduct an exercise using free weights while minimizing the risk of injury to an individual during the acquisition, use, and return of the free weights. The individual has a power zone. The improved method comprises the steps of providing a plurality of cylindrically-shaped free weight plates including a least one pair of said plates comprised of plates of equivalent shape, dimension, and weight, each of the free weight plates having a center of gravity and including a generally cylindrically shaped peripheral edge; and, providing a staging station. The staging station includes a horizontally oriented support surface located above the ground; and, a plurality of detent units each located above the ground and adjacent the horizontally oriented support surface and shaped and dimensioned to support one of the free weight plates in an upright orientation on a portion of said peripheral edge of the one of the plates such that the one of the free weight plates can be rolled on the peripheral edges of the one of the free weights out of the detent unit onto the horizontally oriented support surface, and such that the center of gravity of each of the free weight plates is at an elevation above the ground in the power zone of the individual. The improved method also includes the steps of mounting each of the free weight plates on edge in an upright orientation in one of the detent units of the staging station; manually grasping at least a first one of the free weight plates and rolling the first one of the free weight plates from the detent unit of the one of the free weight plates onto the horizontally oriented support surface; manually removing the first one of the free weight plates from the support surface; utilizing the first one of the free weight plates to perform an exercise; returning the first one of the free weight plates to the support surface; and, rolling the first one of the free weight plates on the peripheral edges of the first one of the free weight plates from the support surface into one of the detent units.

In another embodiment of the invention, we provide an improved method to prepare for and conduct an exercise using free weights while minimizing the risk of injury to an individual during the acquisition, use, and return of the free weights. The individual has a power zone. The improved method comprises the steps of providing a plurality of cylindrically-shaped free weight plates including at least one pair of the plates comprised of plates of equivalent shape, dimension, and weight, each of the plates having a center of gravity and including a cylindrically shaped peripheral edge; and, providing a staging station. The staging station includes a horizontally oriented support surface generally located above the ground at a first elevation; and, a plurality of detent units. The detent units are each located above the ground and adjacent to the horizontally oriented support surface and are shaped and dimensioned to support one of the free weight plates in an upright orientation on a portion of the peripheral edge of one of the plates such that each of the free weight plates can be rolled on the peripheral edge of the free weight plate out of the detent unit onto the horizontally oriented support surface; such that the center of gravity of each of the free weight plates is at a second elevation above the ground in the power zone of the individual; and, such that at least one of the free weight plates in a first one of the detent units is laterally offset from another of the free weight plates in a second one of said detent units. The horizontally oriented support surface maintains the center of gravity of each of the free weight plates above the ground in the power zone of the individual when each of the free weight plates is rolled on the peripheral edge of said free weight plate out of the detent unit onto the horizontally oriented support surface. The improved method also includes the steps of mounting each of the free weight plates on edge in an upright orientation in one of the detent units of the staging station; conducting a precision movement by manually grasping the first one of the free weight plates and rolling the first one of the free weight plates from the detent unit of the first one of the free weight plates onto the horizontally oriented support surface; conducting a gross movement by manually removing the first one of the free weight plates from the support surface and transferring the full plate load to the individual for transport; utilizing the first one of the free weight plates to perform an exercise; conducting a gross movement by manually returning the first one of the free weight plates on to the support surface; and, conducting a precision movement by manually rolling the first one of the free weight plates on the peripheral edges of the first one of the free weight plates from the support surface into one of the detent units.

DETAILED DESCRIPTION OF THE INVENTION

Figure 2:
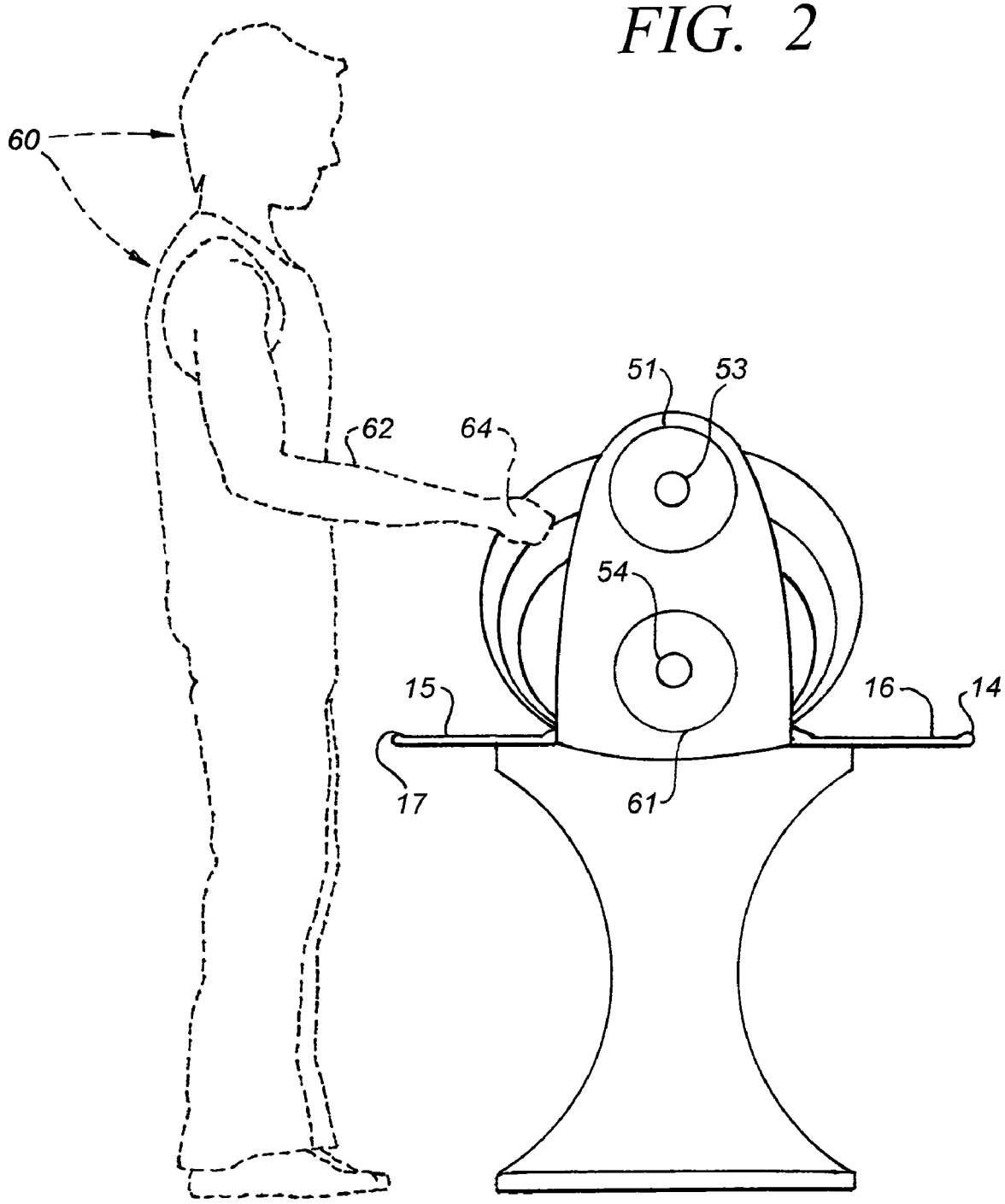
FIG. 2 is a side view of the free weight staging station of FIG. 1 illustrating the mode of operation thereof.
Figure 3:
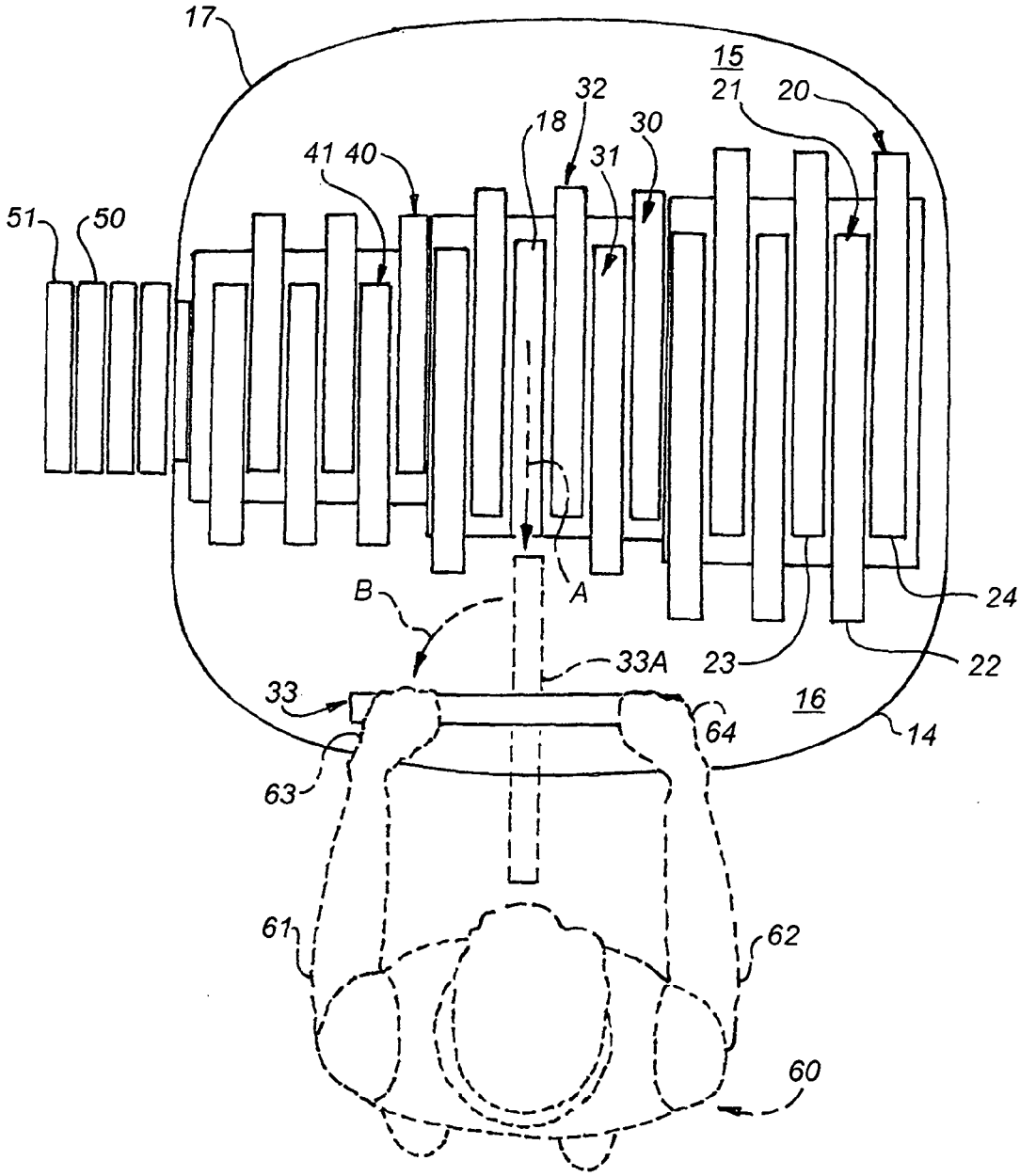
FIG. 3 is a top view of the free weight staging station of FIG. 1 further illustrating the mode of operation thereof; and, FIG. 4 is a front view illustrating the power zone of individuals of varying height.

Turning now to the drawings, which are presented by way of explanation and not limitation of the invention, and in which like reference characters refer to corresponding elements throughout the several views, FIGS. 1 to 3 illustrate an apparatus and method in accordance with the invention.

FIGS. 1 to 3 depict a staging station including a table 11 with ground contacting support legs 12 and 13, horizontally oriented support surfaces 15 and 16, upraised lip 14 extending around the periphery of surface 16, upraised lip 17 extending around support surface 15, and a plurality of concave detent units 18 (FIG. 3). As would be appreciated by those of skill in the art, a staging station can be mounted on a wall, on a pillar, hanging from a ceiling, or from any other desired location. A plurality of cylindrically shaped free weights 20, 21, 30, 31, 32, 33, 40, 41 are each seated in a detent 18 in an upright orientation. Each free weight 20, 21, 30-33, 40, 41 is spaced apart from and generally parallel to the other free weights 20, 21, 30-33, 40, 41. The detent unit 18 for one free weight 20, 21, 30-33, 40, 41 is spaced apart from the detent unit(s) for adjacent free weights 20, 21, 30-33, 40, 41. The weight and shape and dimension of each free weight can vary as desired. However, free weights 20 and 21 presently each weigh forty-five pounds; free weights 30-33 presently each weigh thirty-five pounds; and, free weights 40 and 41 each weigh twenty-five pounds.

Free weights 50 and 51 are stored on sloped shelf 52 and each weigh ten pounds. The shape and dimension of a shelf 52 can be varied as desired to facilitate the storage of weight on the shelf, the removal of weights from the shelf, and the return of weights to the shelf. Free weights 60 and 61 each weigh five pounds and are stored on sloped shelf 62. The shape and dimension of a shelf 62 can be varied as desired to facilitate the storage of weights on the shelf, the removal of weights from the shelf, and the return of weights to the shelf.

Each detent unit, or slot, 18 has a flat, arcuate bottom surface that has a radius of curvature that generally is equivalent and conforms to the radius of curvature of the free weight 20, 21, 30-33, 40, 41 that seats in the detent unit. Accordingly, the radius of curvature of the concave bottom surface of a detent unit that receives and conforms to a portion of the arcuate convex peripheral edge of a forty-five pound weight 20,21 is greater than the radius of curvature of the concave bottom surface of a detent unit 18 that receives and conforms to a portion of the arcuate convex peripheral edge of a thirty-five pound weight 30 to 33, i.e., the diameter of a forty-five pound cylindrical weight 20, 21 is greater than the diameter of a thirty-five pound cylindrical weight 30 to 33. And, the diameter of a thirty-five pound weight 30 to 33 is greater than the diameter of a twenty-five pound weight 40, 41. A detent unit 18 is shaped and dimensioned to receive and support a free weight 20, 21, 30-33, 40, 41 such that the free weight is maintained in an upright, free standing orientation comparable to that illustrated in FIGS. 1 to 3.

In FIG. 1, each free weight 20, 21, 30-33, 40, 41 is parallel to the other of free weights 20, 21, 30-33, 40, 41 and vertically oriented parallel planes extend through the free weights.

A detent unit 18 can extend above and/or below a support surface 15, 16, as long as a free weight 20, 21, 30-33,40, 41 can be rolled from a surface 15, 16 into the detent unit. Accordingly, the detent unit and adjacent support surface 15, 16 can be formed such that a cylindrical shaped weight 20, 21, 30-33, 40, 41 rolls from a support surface 15, 16 directly down into a detent unit, or such that a cylindrically shaped weight 20, 21, 30-33, 40, 41 rolls from a support surface 15, 16 up and over a lip or ridge and then into a concave detent unit.

Free weights 20, 21, 30-33, 40, 41, 50, 51, 61 illustrated in FIGS. 1 to 3 are each, in conventional fashion, cylindrically shaped with an aperture 53, 54 formed through the center. Aperture 53, 54 permits the free weight to be slid onto a storage rod that has an outer diameter that is slightly less than the diameter of aperture 53 and 54. If a free weight has an octagonally, hexagonally, etc. shaped peripheral edge, the free weight is deemed for the purposes herein to be cylindrically shaped. In a similar manner, if a cylindrically shaped free weight has apertures other than a centrally located aperture 53, 54 formed through the free weight at locations intermediate the peripheral edge and the central aperture, the free weight is still deemed to be cylindrically shaped for the purposes herein.

Each detent unit 18 is, as noted, shaped and dimensioned to conform to a portion of the peripheral edge of a free weight 20, 21, 30-33, 40, 41, 50, 51, 61 such that detent unit 18 supports the free weight on edge in an upright orientation in the manner illustrated in FIGS. 1 to 3. The shape and dimension of a detent unit 18 can, accordingly, vary as desired as long as these functions are performed and as long as a cylindrically shaped free weight can be rolled from a support surface 15, 16 into position on the detent unit 18. For example, detent unit 18 can comprise a pair of spaced apart horizontally oriented rods that lie in a common horizontal plane and are spaced apart a distance sufficient for the peripheral edge of a cylindrical free weight to be seated on the rods and contact the rods at two separate locations on the periphery of the free weight so that the free weight will remain in a free standing, upright position comparable to the free standing positions illustrated in FIGS. 1 to 3. As would be appreciated by those of skill in the art, the rods can not be spaced apart a distance greater than the diameter of the free weight that is intended to be seated on the rods.

In FIGS. 1 to 3, each detent unit 18 is spaced apart from adjacent detent units, which results in adjacent free weights being spaced apart from one another. This need not be the case. A single "wide detent unit" can, if desired, be utilized for free weights 30 to 33 of equivalent shape and dimension. Instead of only being wide enough to accept a single free weight 33, as is the case with detent 18, such a "wide detent unit" would permit two or more free weights 30 to 33 to be stored in the same wide detent unit. Free weights 30 to 33 stored in the same detent unit can, if the detent unit is sufficiently wide, be spaced apart or can abut and contact each other. The detent unit that is noted above and is comprised of horizontally oriented rods could use rods that are sufficiently long to permit two or more free weights to be stored on edge, side-by-side, in an upright orientation with at least portions of a circular face of each weight contacting one another. A cylindrically shaped free weight includes a pair of spaced apart, parallel, generally circular faces that co-terminate at the cylindrical peripheral edge of the free weight.

Detent units 18 preferably, but not necessarily, are formed such that adjacent free weights 20 and 21 are laterally offset from one another in the manner illustrated in FIG. 3. This permits an individual 60 to grasp with one hand 64 the edge 22 of one free weight 21 without pinching his fingers on the edges 23 and 24 of adjacent free weights. Individual 60 has arms 61 and 62 and hands 63 and 64. The spacing 71 (FIG. 1) between the faces of adjacent free weights also reduces the likelihood that a user will pinch his or her fingers while manually grasping and removing or replacing free weights from the staging station.

Support surfaces 15 and 16 can be located at any desired elevation above the ground, but preferably are located at an elevation that falls within the power zone of an individual 60, 70, 80 that is standing upright in the manner depicted in FIG. 2. It is further preferred that when a free weight 20, 21, etc. is stored in a detent unit 18 on edge in an upright orientation in the manner illustrated in FIGS. 1 to 3, the center of gravity (e.g., the central aperture formed through the free weight) be located in the power zone of an individual 60 standing upright adjacent to the table 11. Handling weights in the power zone of an individual in accordance with the invention reduces the risk of injury to the individual and improves ambulation.

One method of use of the apparatus of FIG. 3 comprises an upright individual 60 walking to the staging station 10 and performing a precision movement by manually grasping and rolling free weight 33 out of its associated concave detent 18 in the direction of arrow A onto support surface 16 to the position indicated in FIG. 3 by dashed lines 33A. The individual performs a precision motor movement because the free weight 33 is moved from a bounded storage location in which the free weight conforms to and fits in the storage unit, i.e. the detent unit, and is moved from the storage unit directly onto an adjacent support surface 16. With the weight 33 on the support surface, the individual can manually pivot weight 33 in the direction indicated by arrow B and grasp the peripheral edge of the weight with hands 63 and 64 in the manner illustrated in FIG. 3. Throughout the precision movement encompassing removal of weight 33 from detent 18 to pivoting the free weight 33 to improve manual handling, the support surface 16 bears the majority of the free weight load. The precision movement may include an individual repositioning his or her hands 63, 64 on weight 33 before lifting or sliding weight 33. Thus, the precision movement, which demands perception-driven action that is governed by visual inputs and taxes attentional resources, is performed with the benefit of load-support assistance and the individual is not required to counter the full gravitational force on the free weight during the precision movement.

Upon manipulation of the free weight 33 to a position indicated by dashed lines 33A, movement of the weight 33 is no longer constrained by the detent unit 18 and the individual 60 can utilize kinesthetically-driven, gross motor movements to secure the free weight 33 while it is still in the power zone, to remove weight 33 from the support surface 16, and to proceed to the desired exercise location. Gross motor movements are required and appropriate here because the individual must now support the full load of the free weight. Moreover, the movement restrictions during a gross motor movement are on the scale of meters and are much expanded in comparison to the significantly more restrictive movements associated with manipulating a weight 33 to insert it in and remove it from a detent 18.

The ability of the staging station of the invention to provide precise movements is important because injuries tend to occur when an individual is holding above the ground a heavy free weight and is attempting to align the center aperture of the free weight with a rod on which the free weight is stored. Current art requires individuals to orchestrate strength and precision simultaneously, levying significant burdens on muscular endurance, fine motor movements, and visual attention. In the staging station of the invention, such alignment is carried out while the free weight is supported in large part by a surface 15 and 16.

After the individual 60 removes free weight 33, he or she places the free weight 33 on a bar bell or free weight machine and performs an exercise, or otherwise utilizes weight 33 to perform an exercise. After the exercise is completed, or at some other desired time, individual 60 performs a gross movement by carrying weight 33 to table 10 and placing weight 33 on surface 16. The individual then performs a precise movement by, while the weight 33 is in an upright orientation on edge, aligning the weight 33 with detent 18 and rolling weight 33 on edge over surface 16 into detent 18 in an upright orientation with a lower portion of weight 33 seated in detent 18.

Figure 4:
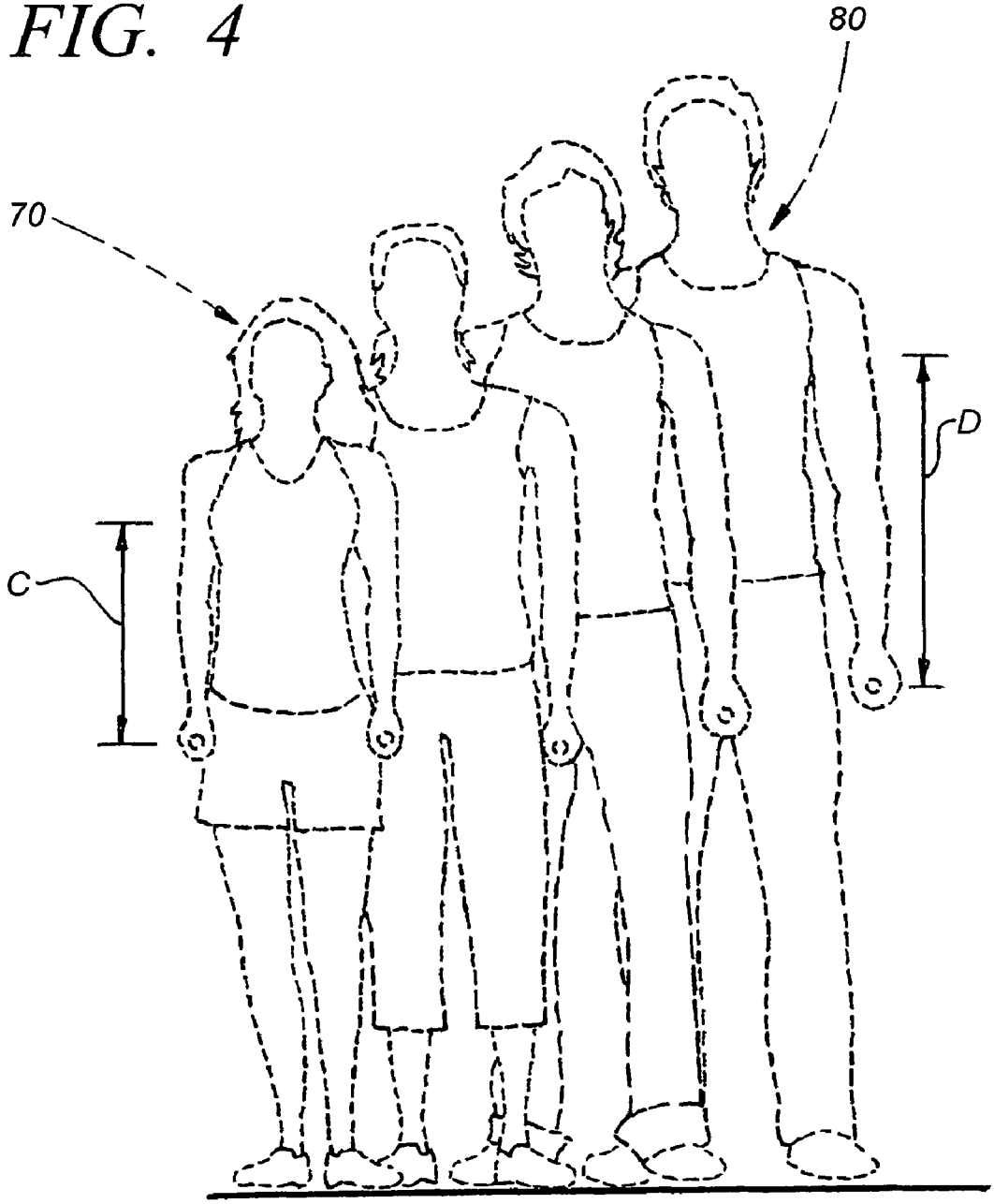

FIG. 4 illustrates the power zone, indicated by arrows C, for a woman 70 of average height (about five feet), and, the power zone, indicated by arrows D, for a man 80 of average height (about six feet).

Having described our invention in such terms as to enable those of skill in the art to understand and practice it, and having described the presently preferred embodiments thereof, We claim:

1. A method to prepare for and conduct an exercise using free weights while minimizing the risk of injury to an individual during the acquisition, use, and return of the free weights, the individual having a power zone, the method comprising the steps of (a) providing a plurality of cylindrically-shaped free weight plates including a least one pair of said plates comprised of plates of equivalent shape, dimension, and weight, each of said free weight plates having a center of gravity and including a generally cylindrically shaped peripheral edge;

(b) providing a staging station including (i) a horizontally oriented support surface located above the ground, and (ii) a plurality of detent units each located above the ground and adjacent said horizontally oriented support surface and shaped and dimensioned to support one of said free weight plates in an upright orientation on a portion of said peripheral edge of said one of said plates such that said one of said free weight plates can be rolled on said peripheral edge of said one of said free weights out of said detent unit onto said horizontally oriented support surface, and said center of gravity of each of said free weight plates is at an elevation above the ground in the power zone of the individual;

(c) mounting each of said free weight plates on edge in an upright orientation in one of said detent units of said staging station;

(d) manually grasping at least a first one of said free weight plates and rolling said first one of said free weight plates from said detent unit of said one of said free weight plates onto said horizontally oriented support surface;

(e) manually removing said first one of said free weight plates from said support surface;

(f) utilizing said first one of said free weight plates to perform an exercise;

(g) manually returning said first one of said free weight plates to said support surface; and (h) manually rolling said first one of said free weight plates on said peripheral edge of said first one of said free weight plates from said support surface into one of said detent units.

2. A method to prepare for and conduct an exercise using free weights while minimizing the risk of injury to an individual during the acquisition, use, and return of the free weights, the individual having a power zone, the method comprising the steps of (a) providing a plurality of cylindrically-shaped free weight plates including a least one pair of said plates comprised of plates of equivalent shape, dimension, and weight, each of said plates having a center of gravity and including a cylindrically shaped peripheral edge;

(b) providing a staging station including (i) a horizontally oriented support surface generally located above the ground at a first elevation, and (ii) a plurality of detent units each located above the ground and adjacent said horizontally oriented support surface and shaped and dimensioned to support one of said free weight plates in an upright orientation on a portion of said peripheral edge of said one of said plates such that each of said free weight plates can be rolled on said peripheral edge of said free weight plate out of said detent unit onto said horizontally oriented support surface, said center of gravity of each of said free weight plates is at a second elevation above the ground in the power zone of the individual, and at least one of said free weight plates in a first one of said detent units is laterally offset from another of said free weight plates in a second one of said detent units, said horizontally oriented support surface maintaining said center of gravity of each of said free weight plates above the ground in the power zone of the individual when each of said free weight plates is rolled on said peripheral edge of said free weight plate out of said detent unit onto said horizontally oriented support surface;

(c) mounting each of said free weight plates on edge in an upright orientation in one of said detent units of said staging station;

(d) conducting a precision movement by manually grasping a first one of said free weight plates and rolling said first one of said free weight plates from said detent unit of said first one of said free weight plates onto said horizontally oriented support surface;

(e) conducting a gross movement by manually removing said first one of said free weight plates from said support surface transferring the full load of said first one of said free weight plates to the individual;

(f) utilizing said first one of said free weight plates to perform an exercise;

(g) conducting a gross movement by manually returning said first one of said free weight plates on to said support surface; and (h) conducting a precision movement by manually rolling said first one of said free weight plates on said peripheral edge of said first one of said free weight plates from said support surface into one of said detent units.

* * * * *